US009862113B2

(12) United States Patent
Jacko

(10) Patent No.: US 9,862,113 B2
(45) Date of Patent: Jan. 9, 2018

(54) SLICING APPARATUSES AND METHODS FOR SLICING PRODUCTS

(71) Applicant: URSCHEL LABORATORIES, INC., Chesterton, IN (US)

(72) Inventor: Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 51 days.

(21) Appl. No.: 15/040,521

(22) Filed: Feb. 10, 2016

(65) Prior Publication Data

US 2017/0225348 A1 Aug. 10, 2017

(51) Int. Cl.

| | |
|---|---|
| ***B26D 1/36*** | (2006.01) |
| ***B26D 1/29*** | (2006.01) |
| ***B26D 1/62*** | (2006.01) |
| ***B26D 7/06*** | (2006.01) |
| ***B26D 1/03*** | (2006.01) |
| ***B26D 7/08*** | (2006.01) |

(52) U.S. Cl.

CPC ..... *B26D 7/0691* (2013.01); *B26D 1/03* (2013.01); *B26D 7/08* (2013.01)

(58) Field of Classification Search

CPC ..... B26D 7/0691; B26D 7/32; B26D 7/0641; B26D 3/26; B26D 1/36; B26D 2001/006; B26D 7/2628; B26D 1/29; B26D 1/62; B26D 1/147; Y10T 83/6473

USPC ..... 83/403, 402, 407, 408, 404.3, 856, 858, 83/356.3, 698.11, 698.41, 698.42, 698.51, 83/703, 165, 932, 343; 241/93, 242, 294, 241/300.1

See application file for complete search history.

(56) References Cited

U.S. PATENT DOCUMENTS

| | | | | |
|---|---|---|---|---|
| 4,523,503 A | | 6/1985 | Julian et al. | |
| 4,813,317 A | * | 3/1989 | Urschel | B26D 1/36 83/356.3 |
| 5,555,787 A | * | 9/1996 | Barber | B23D 35/008 83/403 |
| 5,694,824 A | * | 12/1997 | Jacko | B26D 1/03 83/403 |
| 6,968,765 B2 | | 11/2005 | King | |

(Continued)

OTHER PUBLICATIONS

International Search Report for PCT/US16/062772 dated Feb. 24, 2017.

*Primary Examiner* — Ghassem Alie

(74) *Attorney, Agent, or Firm* — Hartman Global IP Law; Gary M. Hartman; Domenica N.S. Hartman

(57) ABSTRACT

Apparatuses and methods for slicing products. Such an apparatus has an annular-shaped cutting head equipped with knife assemblies located at a circumference of the cutting head, and interior surfaces each located in a circumferential direction of the cutting head relative to one of the knife assemblies such that each interior surface leads one of the knife assemblies and trails a different one of the knife assemblies. Each knife assembly has a flat knife that extends radially inward to define a gate opening. Each interior surface has continuous flow paths defined therein that extend across at least a majority of the interior surface from adjacent a leading edge thereof through a trailing edge thereof and are fluidically connected to one of the gate openings between the interior surface and the knife that trails the interior surface.

16 Claims, 12 Drawing Sheets

(56) References Cited

U.S. PATENT DOCUMENTS

| | | | | |
|---|---|---|---|---|
| 9,517,572 | B2 * | 12/2016 | Michel | B26D 7/0691 |
| 2001/0026824 | A1 | 10/2001 | Caridis et al. | |
| 2004/0079211 | A1 * | 4/2004 | Walker | B26D 1/02 83/165 |
| 2005/0092194 | A1 | 5/2005 | Bajema et al. | |
| 2008/0022822 | A1 | 1/2008 | Jacko et al. | |
| 2014/0007751 | A1 | 1/2014 | Michel et al. | |
| 2014/0230620 | A1 * | 8/2014 | Bucks | B26D 1/36 83/403 |

* cited by examiner

SLICING APPARATUSES AND METHODS FOR SLICING PRODUCTS

BACKGROUND OF THE INVENTION

The present invention generally relates to methods and apparatuses for slicing products. The invention particularly relates to machines having a cutting head equipped with at least one knife suitable for slicing products into slices, wherein the cutting head is configured to promote the stability of the products during slicing.

Various types of equipment are known for slicing, shredding and granulating food products, such as vegetable, fruit, dairy, and meat products. A widely used line of machines for this purpose is commercially available from Urschel Laboratories, Inc., under the name Urschel Model CC®, an embodiment of which is represented in FIG. 1. The Model CC® machine line provides versions of centrifugal-type slicers capable of producing uniform slices, strip cuts, shreds and granulations of a wide variety of products at high production capacities. When used to produce potato slices for potato chips, the Model CC® line of machines can make use of substantially round potatoes to produce the desired circular chip shape with a minimum amount of scrap.

The Model CC® machine 10 schematically represented in FIG. 1 includes a cutting head 12 mounted on a support ring 15 above a gear box 16. A housing 18 contains a shaft coupled to the gear box 16 that rotates an impeller 14 within the cutting head 12 about an axis 17 of the cutting head 12. Products are delivered to the cutting head 12 and impeller 14 through a feed hopper 11 located above the cutting head 12. In operation, the impeller 14 is coaxially mounted within the cutting head 12, which is generally annular-shaped with cutting knives (not shown) mounted at its perimeter. The impeller 14 rotates within the cutting head 12, while the latter remains stationary. The hopper 11 delivers products to the middle of the impeller 14, and centrifugal forces cause the products to move outward into engagement with the knives of the cutting head 12. Further descriptions pertaining to the construction and operation of Model CC® machines, including improved embodiments thereof, are contained in U.S. Pat. Nos. 5,694,824 and 6,968,765, the entire contents of which are incorporated herein by reference.

FIG. 2 is a perspective view of a cutting head 12 and FIGS. 3 and 4 are perspective and cross-sectional views, respectively, of an impeller 14 of types that can be used in the Model CC® machine of FIG. 1. Referring to FIG. 2, each knife 13 of the cutting head 12 projects radially inward toward the interior of the cutting head 12, generally in a direction opposite the rotation of the impeller 14 within the cutting head 12, and defines a cutting edge at its radially innermost extremity. As represented in FIGS. 3 and 4, the impeller 14 comprises generally radially-oriented paddles 28 disposed between a base 30 and an upper ring 32, the latter being omitted in FIG. 4 to reveal the interior of the impeller 14 and orientations of the paddles 28. A frustoconical-shaped flange 34 extends in a generally axial direction from the ring 32 to define an opening 36 through which food products enter the impeller 14. The paddles 28 have faces 38 that engage and direct the products 40 (e.g., potatoes) radially outward towards and against the knives 13 of the cutting head 12 as the impeller 14 rotates.

The cutting head 12 shown in FIG. 2 comprises a lower support ring 18, an upper support ring 20, and circumferentially-spaced support segments (shoes) 22. The knives 13 of the cutting head 12 are individually secured with clamping assemblies 26 to the shoes 22. Each clamping assembly 26 includes a knife holder 26A mounted to the radially inward-facing side of a shoe 22, and a clamp 26B mounted on the radially outward-facing side of a shoe 22 to secure the knife 13 to the knife holder 26A. The shoes 22 are represented as secured with bolts 25 to the support rings 18 and 20. The shoes 22 are equipped with coaxial pivot pins (not shown) that engage holes in the support rings 18 and 20. By pivoting on its pins, the orientation of a shoe 22 can be adjusted to alter the radial location of the cutting edge of its knife 13 with respect to the axis of the cutting head 12, thereby controlling the thickness of the sliced product. As an example, adjustment can be achieved with an adjusting screw and/or pin 24 located circumferentially behind the pivot pins. FIG. 2 further shows optional gate inserts 23 mounted to each shoe 22, which the product crosses prior to encountering the knife 13 mounted to the trailing shoe 22. Each gate insert 23 and its corresponding knife 13 define a gate opening whose width can be adjusted by pivoting the shoe 22 toward and away from the cutting edge of the knife casing 40. As such, the thickness of each slice produced by a knife 13 is determined by the gate opening, and specifically the radial distance between the cutting edge of a knife 13 and the adjacent trailing edge of a gate insert 23. As used herein, "trailing" refers to a position on a cutting head that follows or succeeds another in the direction of rotation of an impeller assembled with the cutting head, whereas "leading" refers to a position on a cutting head that is ahead of or precedes another in the direction opposite the impeller's rotation.

The knives 13 shown in FIG. 2 are depicted as having straight cutting edges for producing flat slices, though knives of other shapes can be installed in Model CC® machines to produce sliced, strip-cut, shredded and granulated products. A nonlimiting example is knives having cutting edges that define a periodic pattern of peaks and valleys when viewed edgewise. The periodic pattern can be characterized by sharp peaks and valleys, or a more corrugated or sinusoidal shape characterized by more rounded peaks and valleys when viewed edgewise. If the peaks and valleys of each knife are aligned with those of the immediate leading knife, slices are produced in which each peak on one surface of a slice corresponds to a valley on the opposite surface of the slice, such that the slices can be substantially uniform in thickness but have a cross-sectional shape that is characterized by sharp peaks and valleys ("V-slices") or a more corrugated or sinusoidal shape (crinkle slices), collectively referred to herein as periodic shapes. Alternatively, shredded product can be produced if each peak of each knife is aligned with a valley of the immediate leading knife, and waffle/lattice-cut product can be produced by intentionally making off-axis alignment cuts with a periodic-shaped knife, for example, by crosscutting a product at two different angles, typically ninety degrees apart. In addition, strip-cut and granulated products can be produced with the use of additional knives and/or cutting wheels located downstream of the knives. Whether a sliced, strip-cut, shredded, granulated, or waffle-cut product is desired will depend on the intended use of the product.

Though flat gate inserts are commonly used for a variety of slicing applications, the gate inserts 23 represented in FIG. 2 have ribs that define raised edges to create a row of openings that precede each knife 13 and through which rocks, sand, and other debris can exit the cutting head 12 without damaging the knives 13 and knife holders 26A. As taught in U.S. Patent Application Publication No. 2014/0007751, to promote phase alignment of potato chips having large-amplitude corrugations, large-amplitude corrugated shoes and gate inserts may be used in combination with large-amplitude corrugated knives for the purpose of maintaining product alignment during slicing.

Model CC® machines such as represented in FIGS. 1-4 are well suited for producing slices from a wide variety of food products. Even so, certain operating conditions can impact the ability of these machines to produce slices of uniform thickness at high production capacities. For example, FIG. 5 schematically represents four shoe sections of the cutting head of FIG. 2 and a condition that may occur that can lead to variability in thicknesses of slices 42 produced during a slicing operation. Water is commonly used as a lubricating fluid in food processing equipment, and a hydroplaning effect occurs to some degree between the products 40 (represented as potatoes) and the shoes 22 and gate inserts 23 prior to and during the slicing operation. Ordinarily, some degree of hydroplaning is desirable, consistent with the intent that the water serves as a lubricant between the products 40 and the interior surfaces of the shoes 22 and gate inserts 23. However, there is a growing trend to recycle water used in such equipment to conserve water and promote the environmental friendliness of the process by reducing the amount of waste water produced. Particularly when slicing potatoes and other starchy food products, the result is that the water may contain a significant amount of starch solids that increase the viscosity of the water and may also behave as an abrasive on the surfaces of the shoes 22 and gate inserts 23. FIG. 5 represents a relatively thick water film 44 present between the products 40 and cutting head 12 and, notably, between the products 40 and the ribs 46 of the gate inserts 23 as more readily apparent from the detailed image in FIG. 5. Such a film 44 can lead to sufficient hydroplaning to cause instability of the products 40 while in contact with the shoes 22 and inserts 23, which can result in variability in the thicknesses of the slices 42. Though such slice variability may be very slight, it may be sufficient to impact the desired uniformity of certain products, for example, fried or baked potato chips, as a result of the possibility of over-cooked and/or under-cooked regions within individual chips.

BRIEF DESCRIPTION OF THE INVENTION

The present invention provides apparatuses and methods suitable for slicing products.

According to one aspect of the invention, an apparatus for slicing products has an annular-shaped cutting head comprising an axis defining an axial direction, knife assemblies located at a circumference of the cutting head, and arcuate interior surfaces each located in a first circumferential direction of the cutting head relative to a corresponding one of the knife assemblies such that each of the interior surfaces leads one of the knife assemblies and trails a different one of the knife assemblies. Each knife assembly comprises a flat knife and means for securing the knife to the cutting head. Each knife extends radially inward and in the first circumferential direction to define a gate opening and produce product slices with parallel cuts and a uniform thickness. Each of the interior surfaces has a plurality of continuous flow paths defined therein that extend across at least a majority of the interior surface from adjacent a leading edge thereof through a trailing edge thereof and are fluidically connected to one of the gate openings between the interior surface and the knife that trails the interior surface.

According to another aspect of the invention, the apparatus further comprising an impeller coaxially mounted within the cutting head for rotation about the axis of the cutting head in a direction opposite the first circumferential direction of the cutting head. A method of using such an apparatus may comprise rotating the impeller, supplying a lubricating fluid to the impeller, supplying products to the impeller that are delivered radially outward toward the cutting head and slicing the products with the knives of the cutting head to produce product slices with parallel cuts and a uniform thickness.

Other aspects of the invention include recycling the lubricating fluid through the cutting head, and the presence of starch solids in the lubricating fluid as a result of the products being starchy food products, for example, potatoes.

Technical effects of apparatuses and methods described above preferably include the ability to reduce slice variability by reducing the thickness of a lubricant film on the surfaces of the shoes and gate inserts, particularly if the lubricant contains recycled water and the product is a starchy food product.

Other aspects and advantages of this invention will be better appreciated from the following detailed description.

DETAILED DESCRIPTION OF THE INVENTION

The present invention provides slicing apparatuses and methods capable of producing a variety of sliced food products, including chips from potatoes, and to sliced products produced therewith. Although the invention will be described herein as slicing food product, it is foreseeable that the slicing apparatuses and methods may be used for slicing other food products and non-food materials, and therefore the scope of the invention should not be limited to any particular products. The slicing apparatuses are preferably adapted to cut food products into slices with generally parallel cuts resulting in food product slices of uniform thickness.

Figure 1:
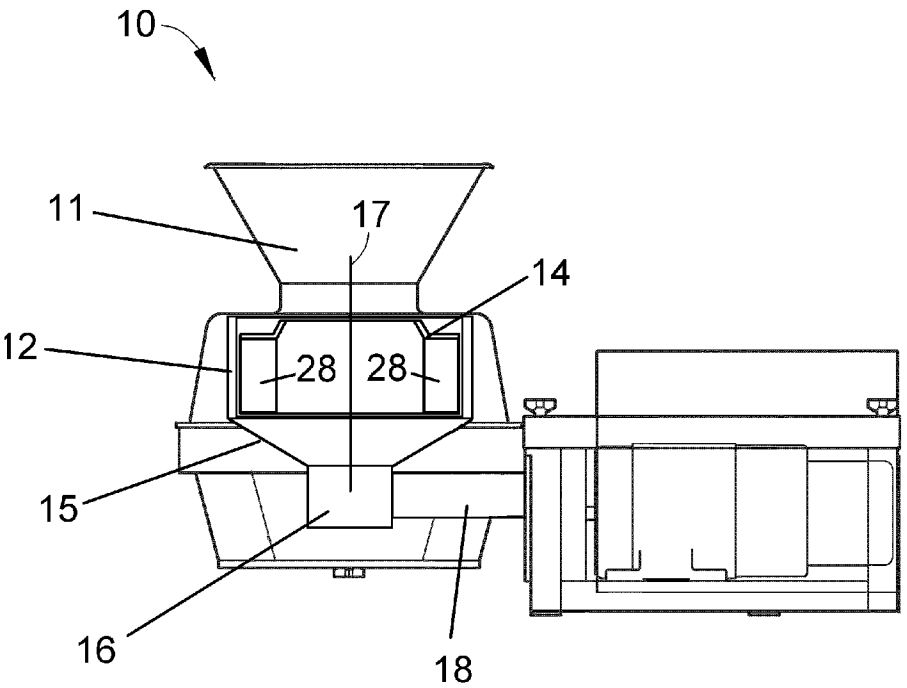
FIG. 1 PRIOR ART
FIG. 1 is a side view in partial cross-section representing a slicing machine known in the art.
Figure 3:
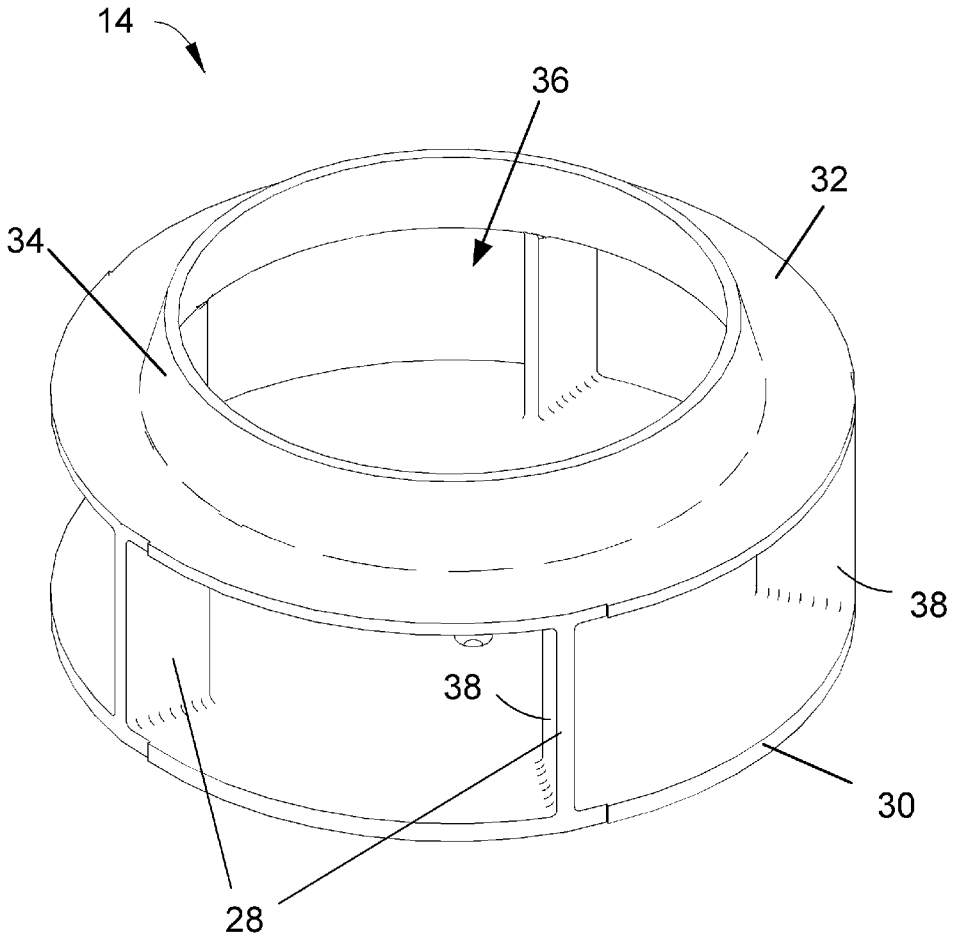
FIG. 3 PRIOR ART
FIG. 3 is a perspective view representing an impeller of a type suitable for use with the slicing machine of FIG. 1 and cutting head of FIG. 2.
Figure 4:
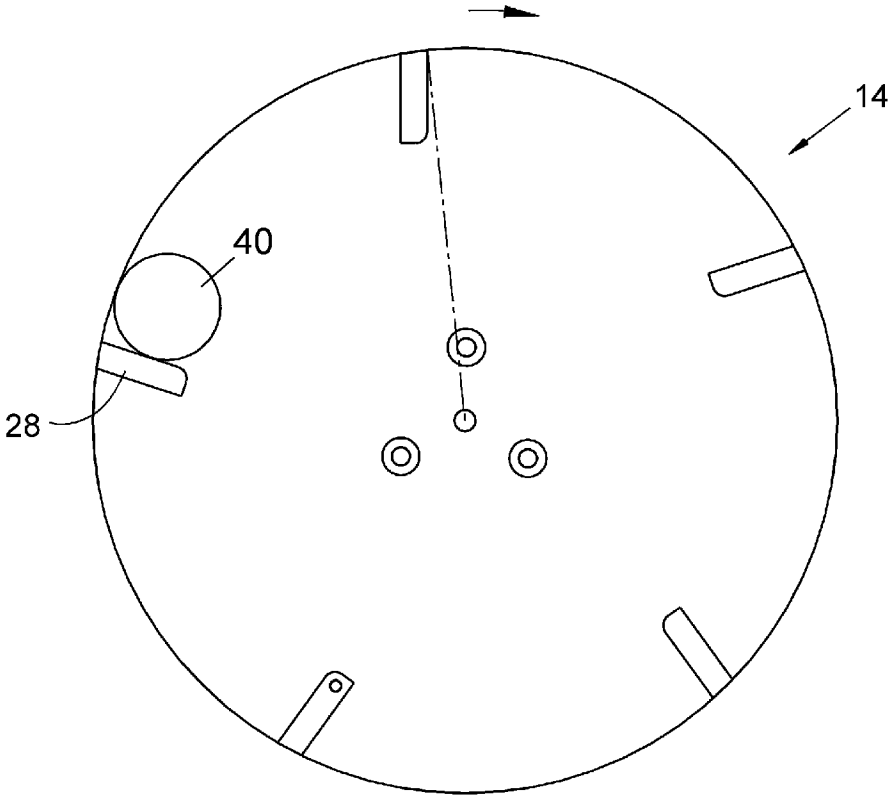
FIG. 4 PRIOR ART
FIG. 4 is a cross-sectional view of the impeller of FIG. 3 indicating its rotation by which products are forced radially outward toward, for example, the cutting head of FIG. 2.
Figure 6:
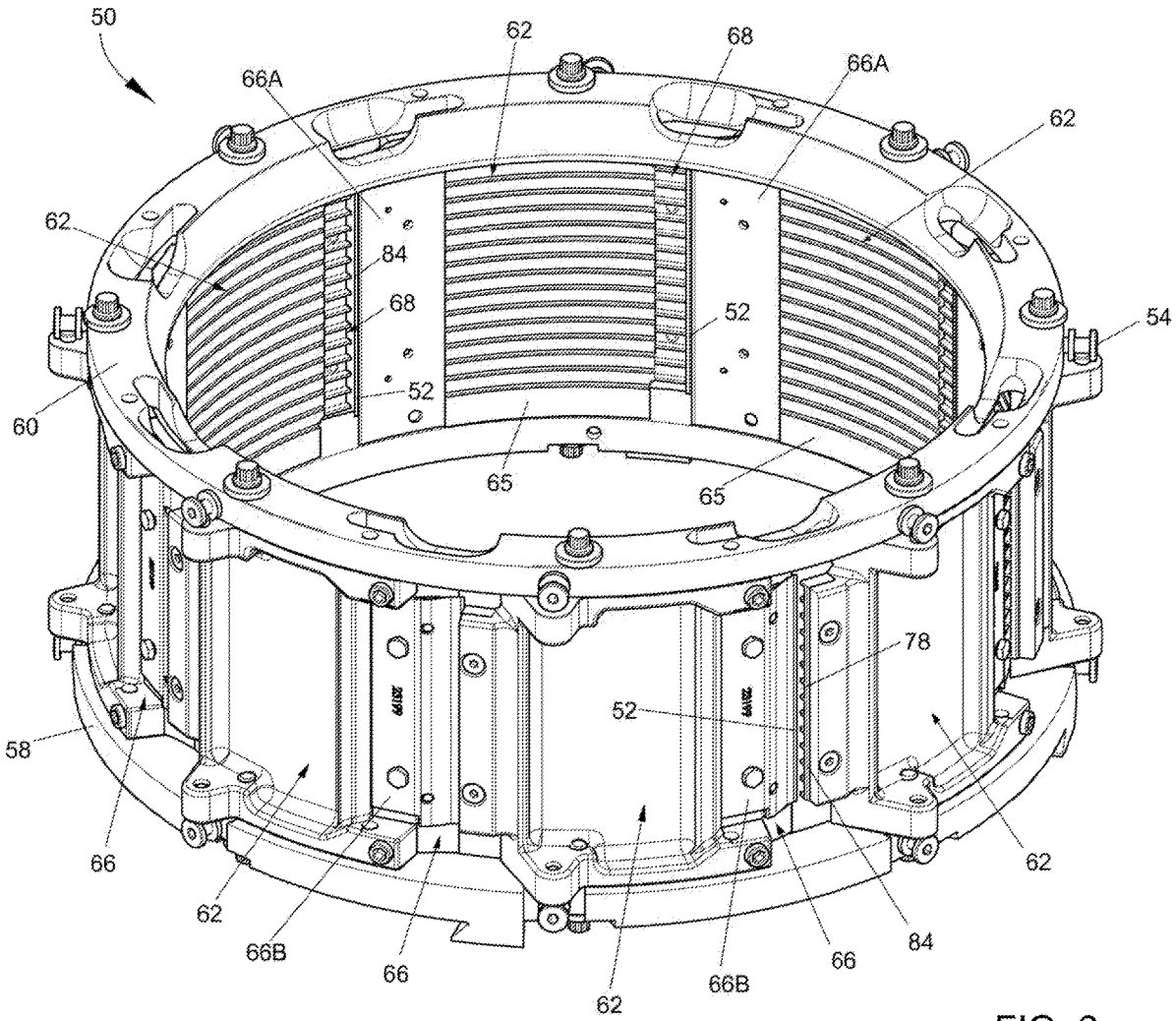
FIG. 6 is a perspective view representing a cutting head in accordance with a non limiting embodiment of the invention and suitable for use in the slicing machine of FIG. 1 and with the impeller of FIGS. 3 and 4.
Figure 7:
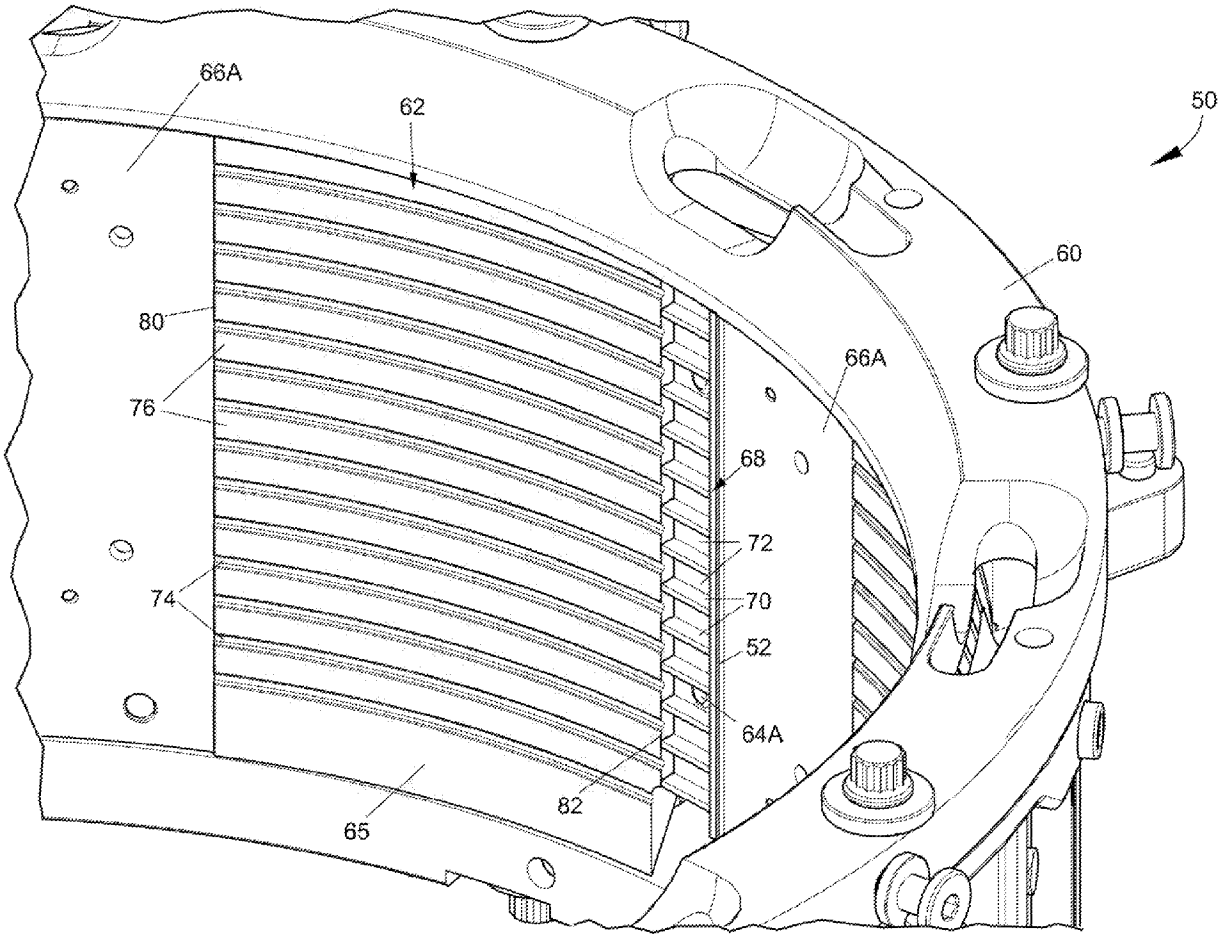
FIG. 7 represents a portion of the cutting head of FIG. 6 showing in more detail a shoe and gate insert of the cutting head.

FIGS. 6 and 7 show a cutting head 50 in accordance with a nonlimiting embodiment of the present invention. The cutting head 50 is configured for use in a slicing machine, as a nonlimiting example, the centrifugal-type slicing machine 10 represented in FIG. 1, and in combination with an impeller, as a nonlimiting example, the impeller 14 represented in FIGS. 1, 3 and 4, in which case the impeller 14 is mounted within the cutting head 50 for rotation about the axis of the cutting head 50. However, other configurations of impellers adapted for installation and rotation in an annular-shaped cutting head could be used as discussed above in reference to FIGS. 1 through 4. Accordingly, though the cutting head 50 will be discussed below in reference to the impeller 14 of FIGS. 1, 3 and 4, it should be understood that the cutting head 50 can find suitable use with impellers other than what is shown in the drawings.

Figure 5:
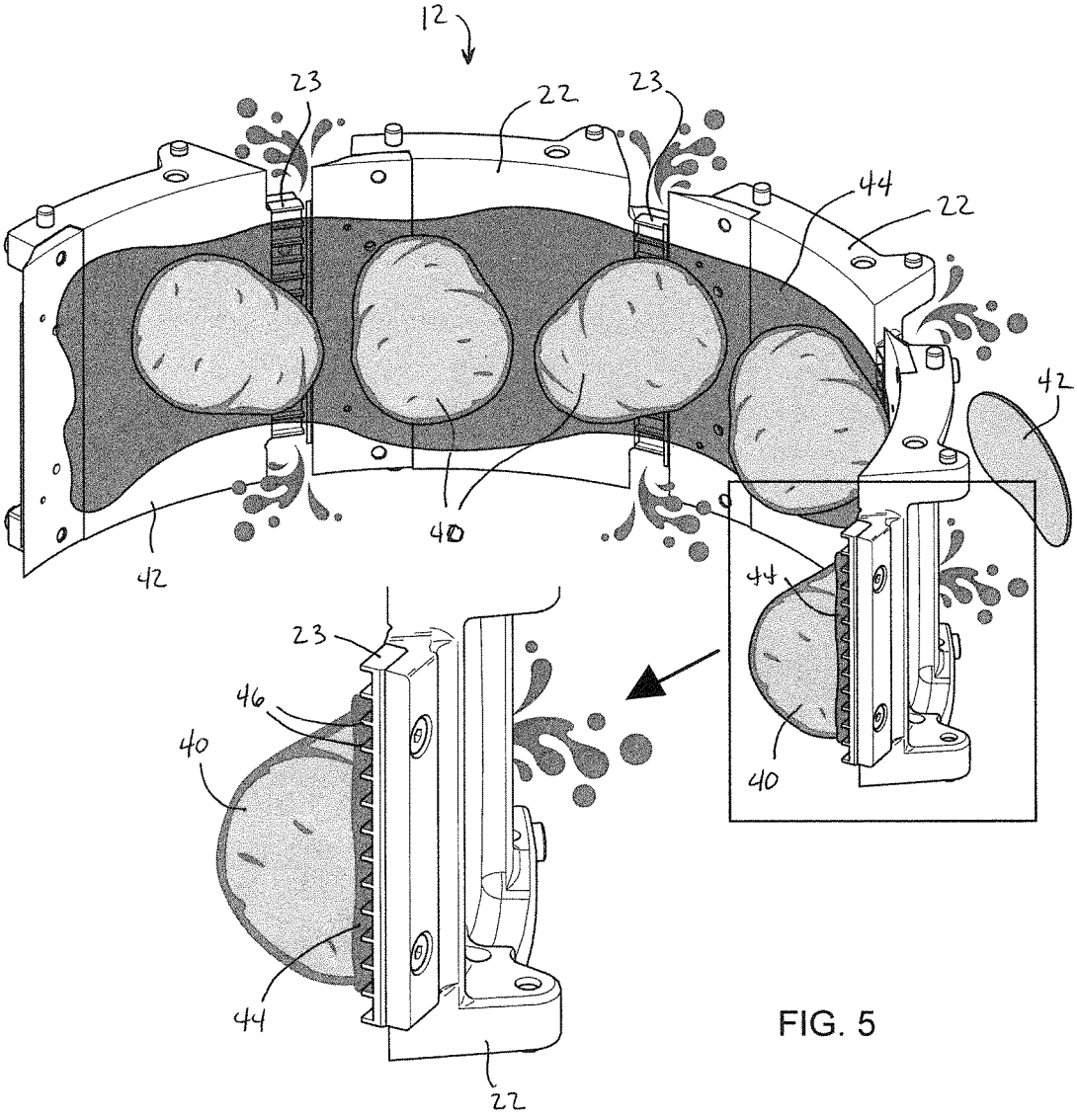
FIG. 5 schematically represents an operating condition that can occur with the machine, cutting head and impeller represented in FIGS. 1 through 4.

The cutting head 50 is represented in FIGS. 6 and 7 as having an annular shape with multiple knife assemblies arranged and spaced around the circumference of the cutting head 50. Each knife assembly includes a knife 52 and means for securing the knife 52 to the cutting head 50. In the nonlimiting embodiment shown in FIGS. 5 and 6, the securing means includes clamping assemblies 66, each including a knife holder 66A mounted to the radially inward-facing side of one of a number of circumferentially-spaced shoes (support segments) 62, and a clamp 66B mounted on the radially outward-facing side of the same shoe 62 to secure a knife 52 to the knife holder 66A. Each knife 52 is mounted to extend in a radially inward direction of the cutting head 50, so as to project toward an impeller that would be mounted for rotation within the cutting head 50 (for example, as represented by the impeller 14 in FIG. 1). Each knife 52 has a cutting edge that terminates at a knife tip. The knives 52 shown in FIGS. 6 and 7 are depicted as "flat" knives, which as used herein means that the cutting edges of the knives 52 are straight to produce flat slices.

Each shoe 62 is mounted between lower and upper support rings 58 and 60, to which the shoe 62 is pivotally coupled so that its orientation can be adjusted to alter the radial location of the cutting edge of its knife 52 with respect to the axis of the cutting head 50, thereby controlling the thickness of a sliced product produced with the knife 52. As an example, adjustment can be achieved with an adjusting screw and/or pin 54 located circumferentially behind the pivot axis of the shoe 62. FIGS. 6 and 7 further show gate inserts 68 mounted circumferentially behind (trailing) a trailing edge 82 of each shoe 62. Each insert 68 is preferably directly secured to its corresponding shoe 62, for example, with fasteners 64A assembled within bores 64B (FIG. 8A) provided in a trailing flange 63 of the shoe 62. Consistent with the annular shape of the cutting head 50, interior surfaces of each shoe 62 and insert 68 have arcuate shapes. An impeller mounted for rotation within the cutting head 50 (while the latter remains stationary) causes products delivered thereto (for example, with a hopper of a type represented in FIG. 1) to move outward under centrifugal forces and engage the knives 52 of the cutting head 12. In so doing, the products contact and move across an interior surface 65 of a shoe 62 and an interior surface of gate insert 68 prior to encountering one of the knives 52 mounted to an immediately trailing shoe 62. The gate inserts 68 are the last surfaces contacted by products prior to engaging the knives 52, and the trailing edge 84 of each gate insert 68 (FIG. 7) and the immediately trailing knife 52 define a gate opening 78 that determines the thickness of a slice produced by the knife 52. The width of the gate opening 78 is adjusted by pivoting the leading shoe 62 toward and away from the cutting edge of the trailing knife 52 to alter the radial distance between the cutting edge of a knife 52 and the adjacent trailing edge 84 of the gate insert 68.

Figure 2:
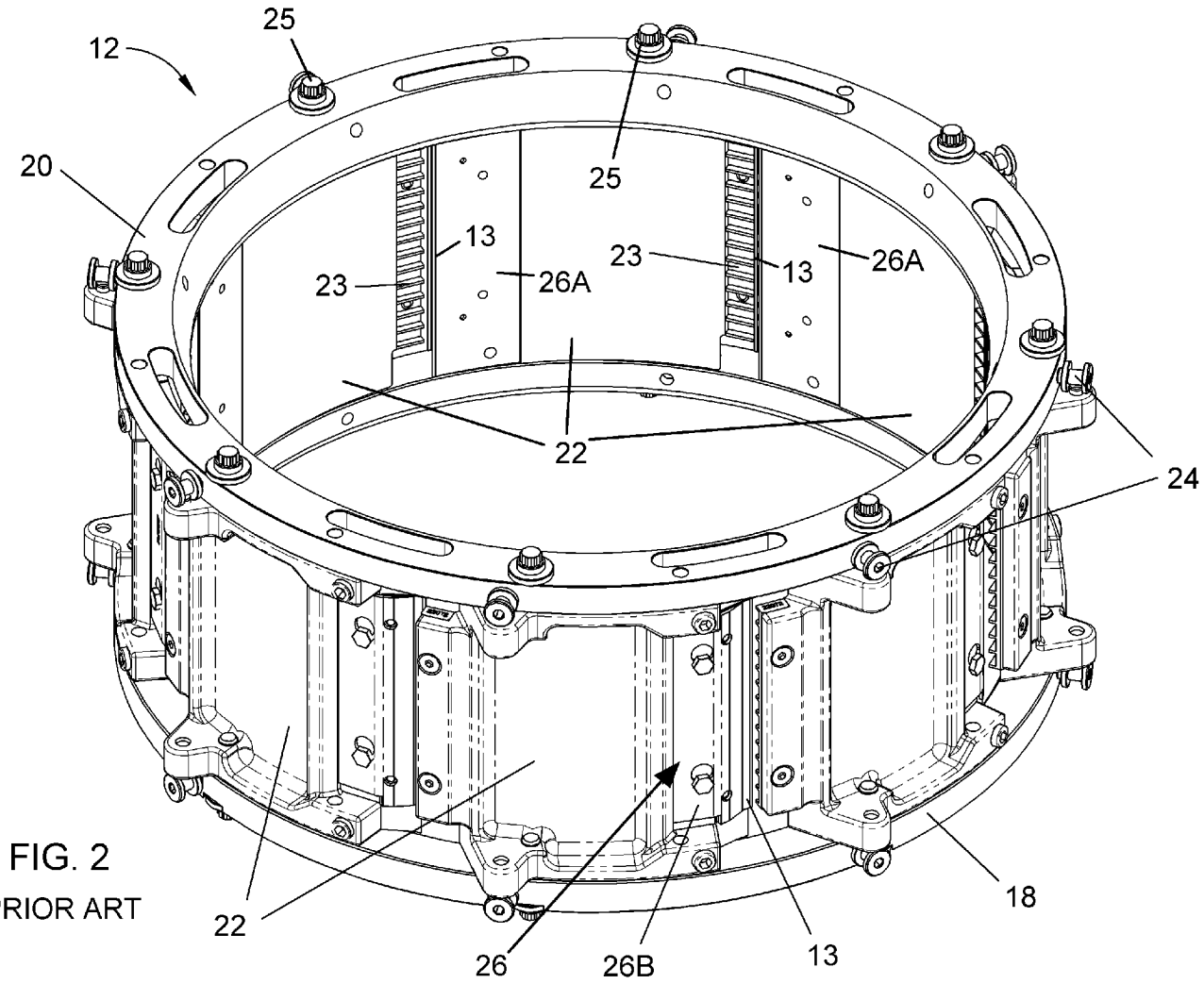
FIG. 2 PRIOR ART
FIG. 2 is a perspective view representing a cutting head of a type suitable for use with the slicing machine of FIG. 1.

The gate inserts 68 represented in FIGS. 6 and 7 are similar to the gate inserts 23 represented in FIG. 2, in that each insert 68 has ribs 70 that define raised edges to create a row of channels 72 that are separated from each other by one of the ribs 70. The channels 72 define a row of openings that precede the immediately trailing knife 52 and through which rocks, sand, and other debris can exit the cutting head 50 without damaging the knives 52 and knife holders 66A. FIGS. 6 and 7 further represent the shoes 62 as having channels 74 recessed into their interior surfaces 65. According to one aspect of the invention, the channels 72 and 74 of the inserts 68 and shoes 62 are "aligned channels," which as used herein means the channels 72 and 74 are parallel to each other and perpendicular to the axis of the cutting head 50 and to the axis of an impeller mounted for rotation within the cutting head 50, such that the channels 72 and 74 are aligned with the direction that products travel across the interior surfaces 65 of the shoes 62 and across the interior surfaces of the inserts 68. According to a preferred aspect of the invention, each channel 74 of a shoe 62 is individually aligned with one of the channels 72 of its trailing gate insert 68 to create a continuous flow path from the leading edge 80 of the shoe 62 adjacent the immediately leading knife holder 66A to the gate opening 78 defined between the trailing edge 84 of the insert 68 and its immediately trailing knife 52. Positive and precise alignment of the channels 72 and 74 can be achieved and maintained as a result of each insert 68 being directly secured to its corresponding shoe 62, as discussed above.

The aligned channels 74 in the shoes 62 shown in FIGS. 6 and 7 have smaller cross-sectional areas than the aligned channels 72 formed by the gate inserts 68 as a result of being narrower and shallower than the aligned channels 72. As more readily seen in FIGS. 8A and 8B, the aligned channels 74 of the shoes 62 have U-shaped cross-sections, for example, a cross-section that is semicircular or a circular segment, and therefore differ in cross-sectional shape from the rectangular-shaped cross-sections of the aligned channels 72 of the gate inserts 68. Suitable depths and widths for the channels 74 are believed to be in a range of about 0.75 to 2.5 mm, with the widths of the channels 74 typically being greater than their depths, though shallower, deeper, narrower, and wider channels 74 are foreseeable. By fabricating the aligned channels 74 to have sufficiently large cross-sectional areas, the aligned channels 72 and 74 are able to reduce hydroplaning of products contacting the shoes 62 prior to and during the slicing operation when water (or another liquid) is used as a lubricating fluid.

Figure 8A:
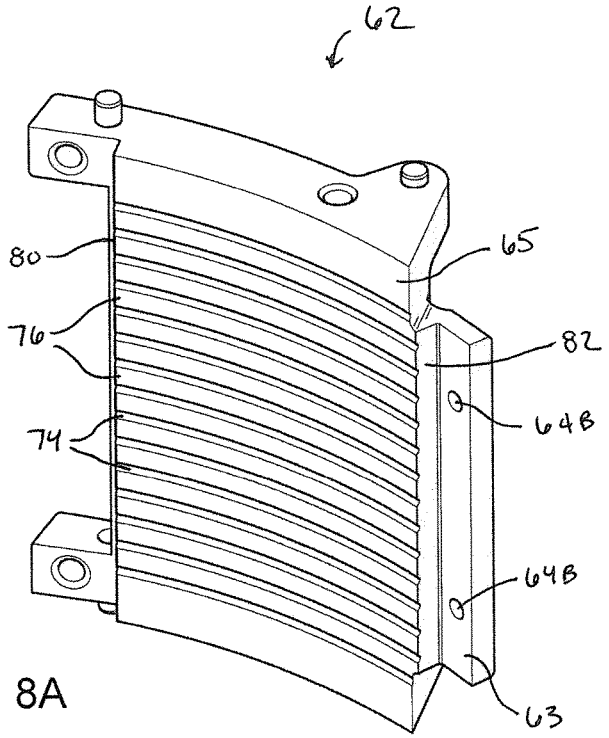
FIG. 8 is an isolated view of one of the shoes of the cutting head of FIGS. 6 and 7.
Figure 8B:
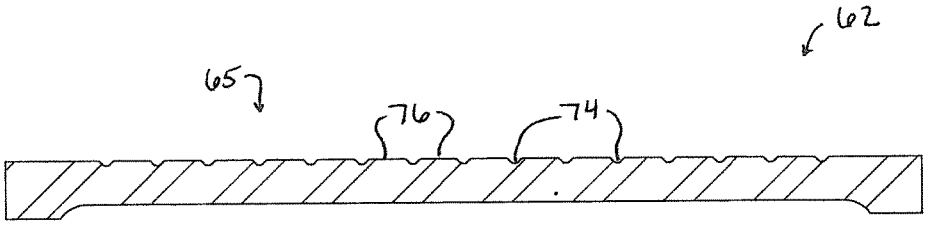

As also apparent from FIGS. 8A and 8B, surfaces 76 of the shoes 62 between the aligned channels 74 are "flat," which in the sense of the arcuate shapes of the shoes 62 means that, though the surfaces 76 appear arcuate when viewed in a direction parallel to the axis of the cutting head 50, the surfaces 76 are collinear when viewed in cross-section along a section parallel to the axis of the cutting head 50, as seen in the surface geometry (profile) of FIG. 8B. As such, products engaging the interior surfaces 65 of the shoes 62 do not contact a raised feature, such as peaks of a corrugated surface intended to maintain product alignment during slicing. Instead, the continuous flow paths formed by the aligned channels 72 and 74 are recessed below the surfaces 76 of the shoes 62, and products engaging the interior surfaces 65 of the shoes 62 are supported by what is defined herein as "flat" surfaces 76 (when viewed as a cross-section parallel to the axis of the cutting wheel 50). In addition, the surfaces 76 of the shoes 62 are significantly wider (in the axial direction of the cutting head 50) than the aligned channels 74. For example, FIG. 8B represents a width ratio of greater than 2:1 and approaching 4:1, in other words, the surfaces 76 in the embodiment of FIGS. 8A and 8B account for greater than 50% and up to about 75% of the surface 65 of each shoe 62.

From the foregoing, it can be appreciated that in combination the shoes 62 and gate inserts 68 define interior surfaces of the cutting head 50, and each such interior surface leads the knife 52 of a trailing knife assembly and trails the knife 52 of a leading knife assembly. In FIGS. 6, 7, 8A and 8B, the continuous flow paths defined by the aligned channels 72 and 74 of the shoes 62 and gate inserts 68 extend from the leading edge 80 of the shoe 62 to the trailing edge 84 of the gate insert 68 in order to be fluidically connected to the trailing gate opening 78. However, it is foreseeable that acceptable results could be obtained as long as the leading ends of the continuous flow paths are sufficiently close (adjacent) to the leading edge 80 of the shoe 62, for example, by extending across the majority of the interior surface 65 of the shoe 62. In some embodiments, the gate inserts 68 may be omitted, in which case the flange 63 could also be omitted and the interior surfaces 65 of the shoes 62 (i.e., between the leading and trailing edges 80 and 82 of each shoe 62; FIG. 7) would define the entirety of the interior surfaces of the cutting head 50 between the knife assemblies.

Figure 9:
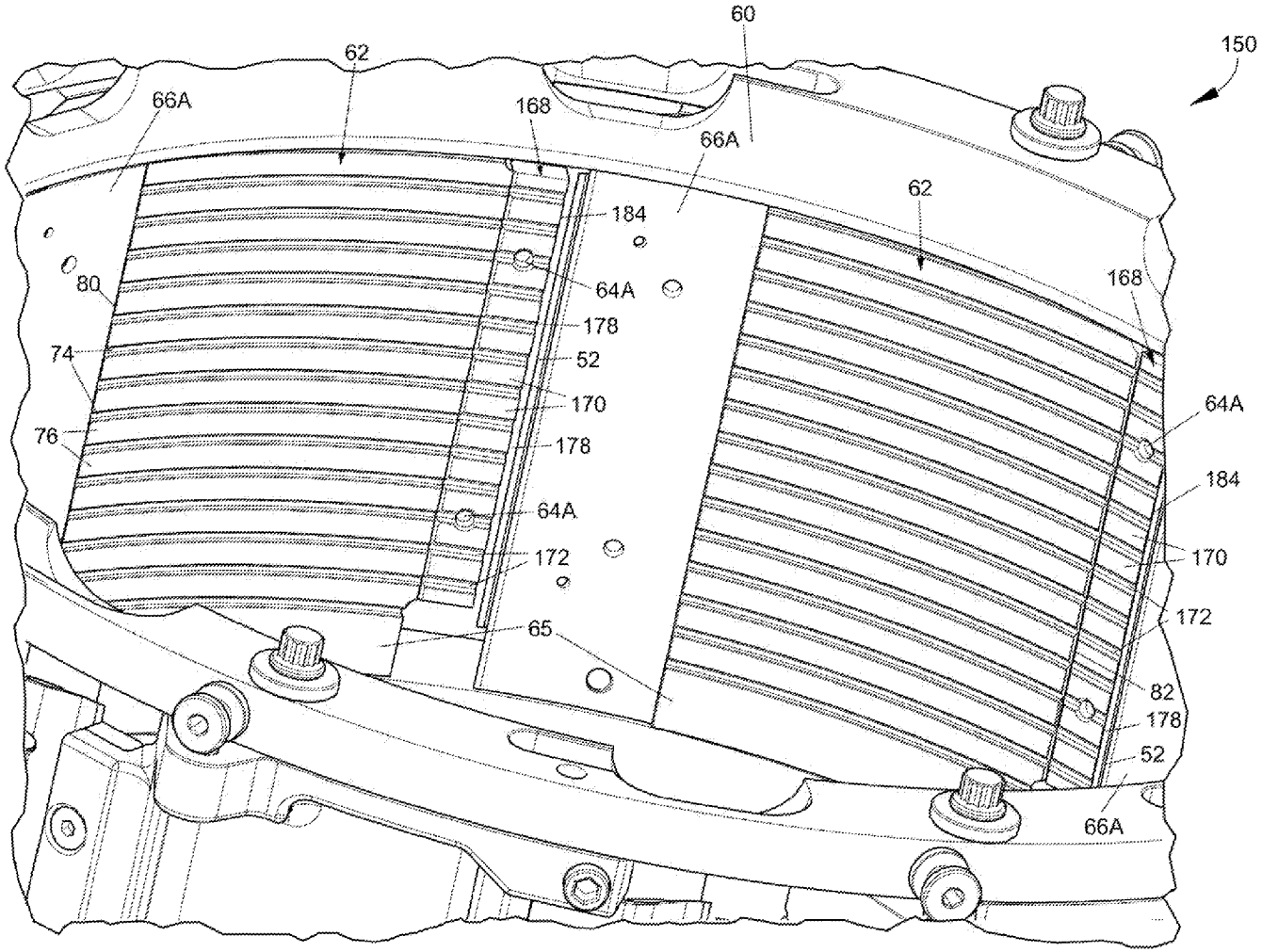
FIG. 9 is a detailed view of a portion of a cutting head similar to FIGS. 6 and 7, but with an alternative configuration for the gate insert.

The effect on hydroplaning noted above is schematically represented in FIG. 10 in reference to a cutting head 150 represented in FIG. 9 as identical to the cutting head 50 of FIGS. 6 and 7 except for gate inserts 168 that differ from those of FIGS. 6 and 7 by having an interior surface with aligned channels 172 whose cross-sectional shape are U-shaped (for example, a cross-section that is semicircular or a circular segment), and more nearly match that of the aligned channels 74 in the shoes 62. In other words, the surface geometry of the aligned channels 172 is essentially identical to the surface geometry shown in FIG. 8B, and surfaces 170 of the inserts 168 between the aligned channels 172 are flat and collinear when viewed in cross-section along a section parallel to the axis of the cutting head 150. As such, products engaging the interior surfaces of the inserts 168 do not contact raised features such as the raised edges of the ribs 70 shown in FIGS. 6 and 7. Instead, the aligned channels 74 and 172 are recessed below the surfaces 76 and 170 of the shoes 62 and gate inserts 168, again creating continuous flow paths that extend from the leading edges 80 of the shoes 62 to the trailing edges 184 of the inserts 168 to reduce hydroplaning of products contacting the inserts 168 and shoes 62 prior to and during the slicing operation. The depth and width of each channel 172 are preferably at least equal to, respectively, the depth and width of the channel 74 with which it is aligned, and in certain embodiments are greater than the depth and width of the aligned channel 74, for example, in a range of about 1 to 3 mm, with the result that the aligned channels 74 in the shoes 62 have smaller cross-sectional areas than the aligned channels 172 of the gate inserts 168. The widths of the channels 172 are typically greater than their depths, though shallower, deeper, narrower, and wider channels 172 are foreseeable.

Figure 10:
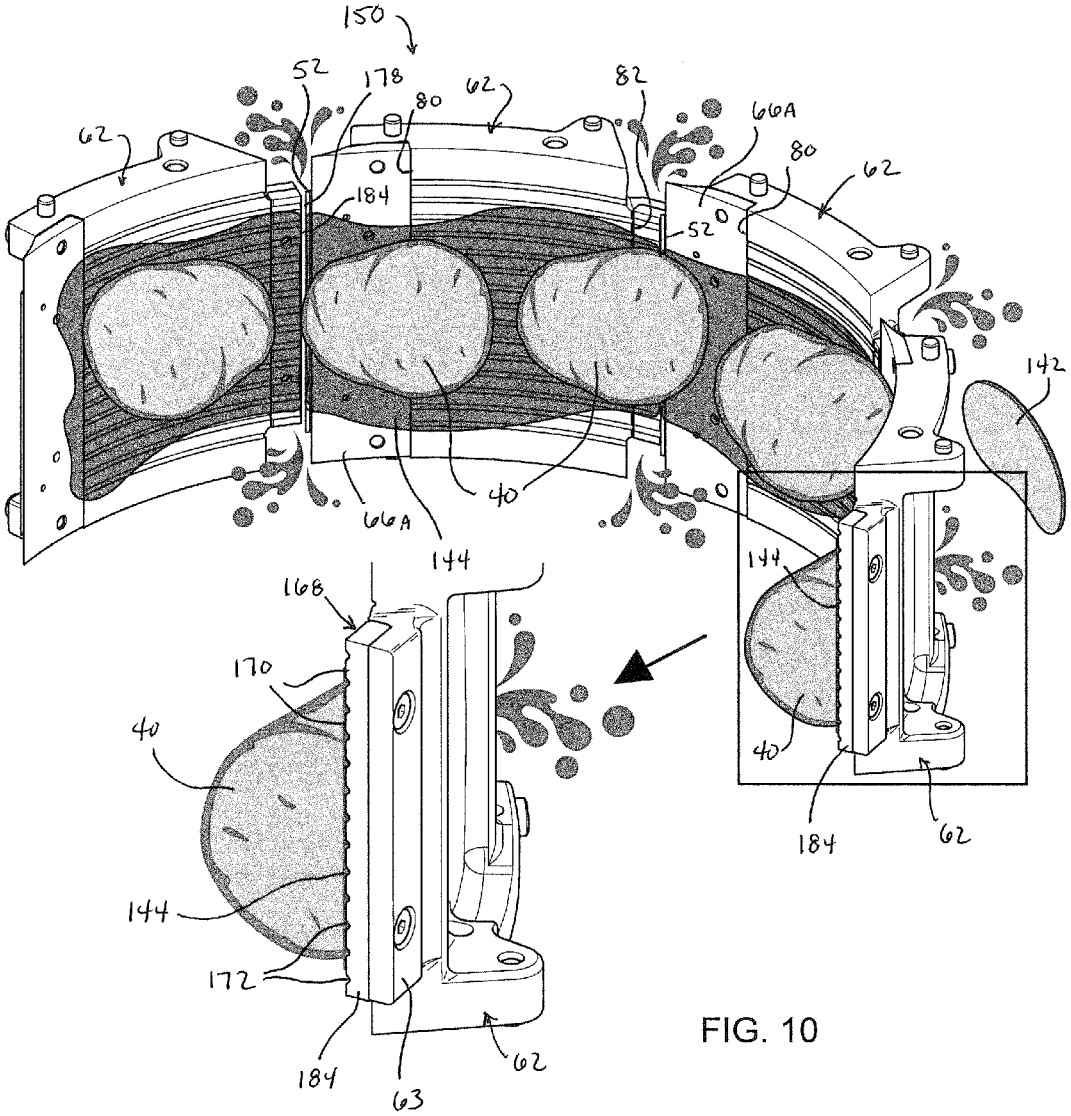
FIG. 10 schematically represents an operating condition of a cutting head equipped with shoes of FIGS. 6 through 9 and the gate insert of FIG. 9.

In FIG. 10, four shoe sections of the cutting head 150 of FIG. 9 are schematically represented. A rotating impeller within the cutting head 150 is omitted for clarity, but it should be understood that an impeller is present, a lubricating fluid and products 40 are supplied to the impeller, and the products 40 are delivered radially outward toward the cutting head 150 to undergo slicing with knives 52 to produce product slices 142 of uniform thickness. FIG. 10 also illustrates that some degree of hydroplaning is present, consistent with the intent that water (or another fluid) serves as a lubricant between the products 40 and the interior surfaces of the shoes 62 and gate inserts 168. However, FIG. 10 schematically represents that a much thinner water film 144 is present between the products 40 and cutting head 150, as apparent from the detailed image in FIG. 10. Though the film 144 between the products 40 and the surfaces 170 of the gate inserts 168 is most readily seen in FIG. 10, the film 144 is also present between the products 40 and the surfaces 76 of the shoes 62 and the thickness of the film 144 may be similar between the leading edges 80 of the shoes 62 and the trailing edges 184 of the inserts 168 due to the similar surface geometries of the shoes 62 and inserts 168. The thinner film 144 is the result of the presence of the continuous flow paths formed by the aligned channels 74 and 172 recessed below the surfaces 76 and 170 of the shoes 62 and gate inserts 168. The aligned channels 74 and 172 drain water from the film 144 on the surfaces 76 and 170 and conduct the water toward the gate opening 178 between the insert 168 and its trailing knife 52.

By reducing the thickness of the film 144, hydroplaning can be reduced to promote stability of the products 40 while in contact with the shoes 62 and inserts 168, thereby reducing variability in the thicknesses of the slices 142 and promoting uniformity of products produced from the slices 142, for example, fried or baked potato chips that may have over-cooked and/or under-cooked regions within individual chips if the slices 142 were not sufficiently uniform in thickness. The effect of the continuous flow paths formed by the aligned channels 74 and 172 is especially beneficial under conditions in which water used in the slicing operation contains a significant amount of starch solids as a result of being recycled to conserve water and promote the environmental friendliness of the process by reducing the amount of waste water produced. Starch solids content can be a particular issue if slicing potatoes or another starchy food product, leading to increased viscosity of the water and abrasion of the surfaces of the shoes 62 and gate inserts 168.

To achieve consistently well-defined surface geometries and alignment with the channels 72/172 formed in the gate inserts 68/168, the U-shaped aligned channels 74 represented in FIGS. 6-10 are preferably machined in the interior surface 65 of the shoe 62, though other fabrication techniques are foreseeable. The shoes 62 represented in FIGS. 6-10 have fifteen U-shaped channels 74, thirteen of which are aligned with thirteen U-shaped or rectangular channels 72/172 of the gate inserts 68/168 to create thirteen continuous flow paths between the immediately leading knife holder 66A and the gate opening 78/178 with the immediately trailing knife 52. The two excess aligned channels 74 of the shoes 62 are located at opposite ends of the row of parallel channels 74 on each shoe 62 and can deliver water above and below the corresponding inserts 68/168.

Figure 11A:
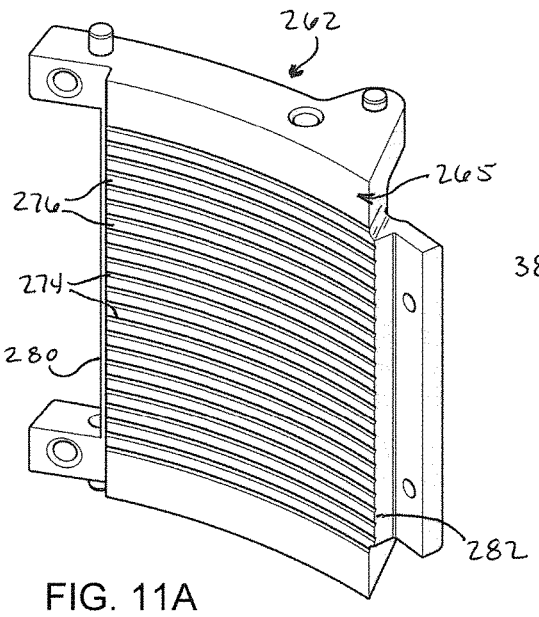
FIGS. 11A through 11D and 12A through 12B are isolated views of alternative configurations for shoes suitable for use with the cutting head of FIG. 6 and the gate inserts of FIGS. 6 through 9.

According to additional aspects of the invention, the surface geometries of shoes and gate inserts installed in a cutting head can differ from those shown in FIGS. 6 through 10. As a nonlimiting example, FIG. 11A represents a shoe 262 in whose interior surface 265 twenty-two U-shaped aligned channels 274 have been formed and extend from the leading edge 280 to the trailing edge 282 of the shoe 262. Each aligned channel 274 may be aligned with one of an equal number of aligned channels (e.g., 72 or 172) of an insert (e.g., 68 or 168) or more than one channel 274 may be aligned with each channel 72/172 of an insert 68/168 to create continuous flow paths that extend from the leading edge 280 of the shoe 262 to the trailing edge 84/184 of the gate insert 68/168.

Figure 11B:
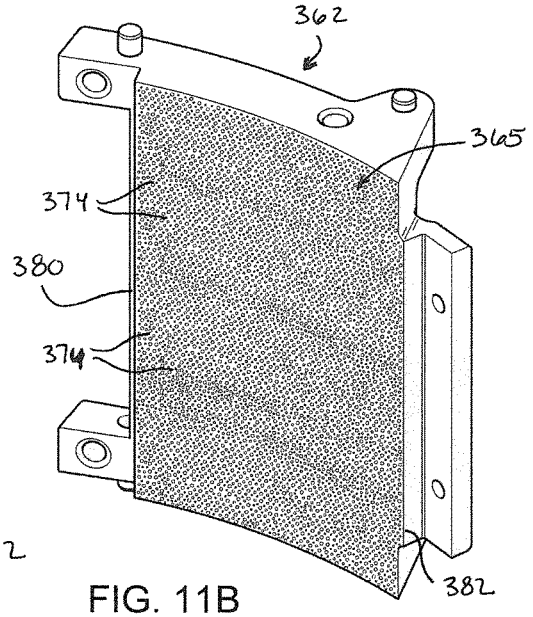
Figure 11C:
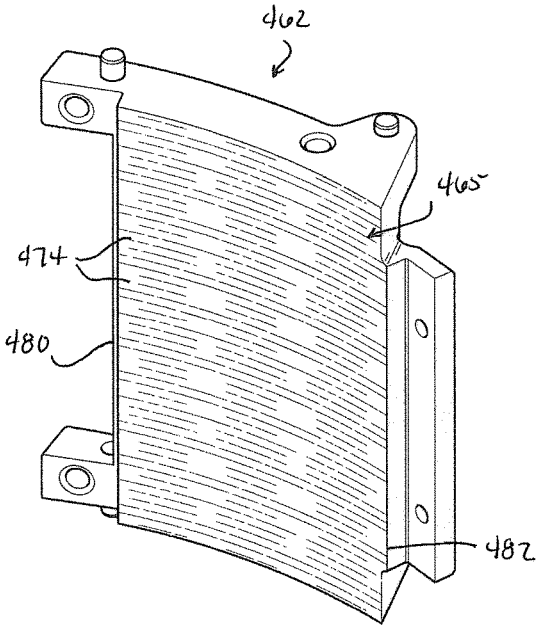
Figure 11D:
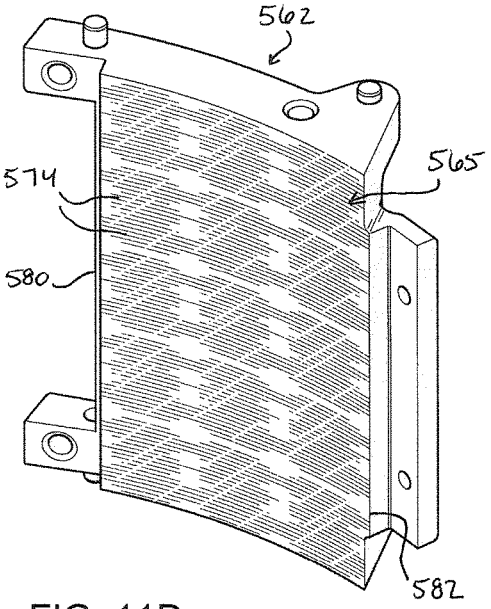

FIGS. 11B, 11C and 11D depict three different shoes 362, 462, and 562 that do not have aligned channels (as defined herein), but instead have random continuous flow paths as a result of the manner in which channels are formed in their interior surfaces 365, 465 and 565, respectively. In particular, FIG. 11B represents the interior surface 365 of the shoe 362 as having been grit blasted to create random interconnected channels 374 that extend from the leading edge 380 to the trailing edge 382 of the shoe 362, FIG. 11C represents the interior surface 465 of the shoe 462 as having been sanded with a relatively coarse grit (e.g., CAMI 60) to create random interconnected channels 474 that extend from the leading edge 480 to the trailing edge 482 of the shoe 462, and FIG. 11D represents the interior surface 565 of the shoe 562 as having been sanded with a finer grit (e.g., CAMI 80) to create random interconnected channels 574 that extend from the leading edge 580 to the trailing edge 582 of the shoe 562. The sanding processes used to produce the channels 474 and 574 may result in the channels 474 and 574 being somewhat less random than the channels 374 formed by grit blasting, and to some degree aligned as indicated by FIGS. 11C and 11D. In each case, the random channels 374, 474, and 574 must be sufficiently deep and interconnected to create continuous flow paths across their respective surfaces 365, 465, and 565. In investigations leading to the present invention, shoes 62 and 262 with aligned channels 74 and 274 were shown to be more effective in reducing hydroplaning than shoes 362, 462, and 562 with random channels 374, 474, and 574.

Figure 12A:
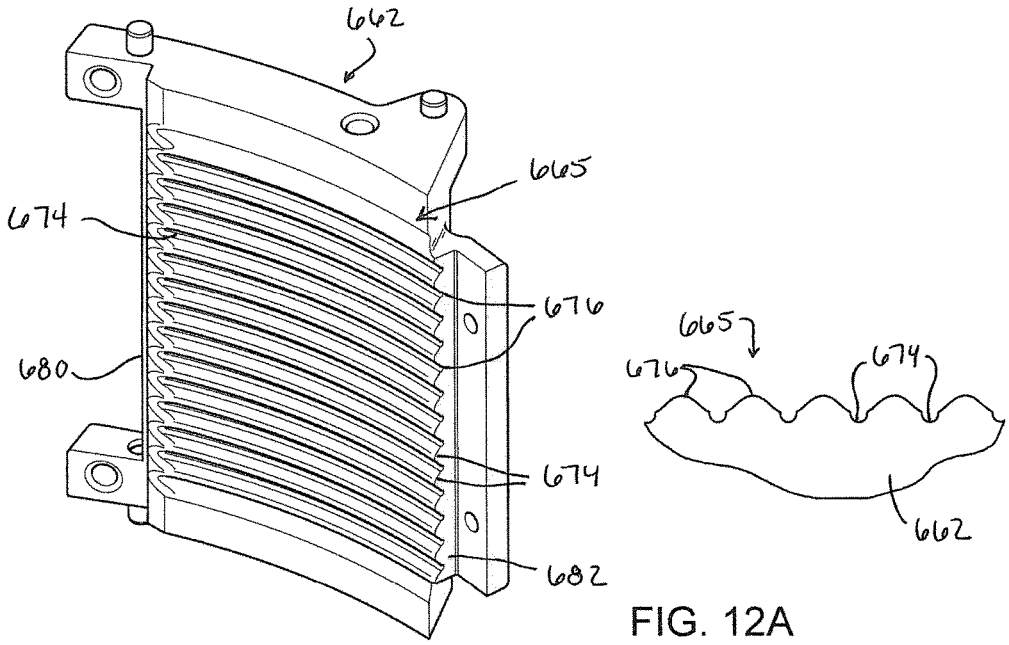
Figure 12B:
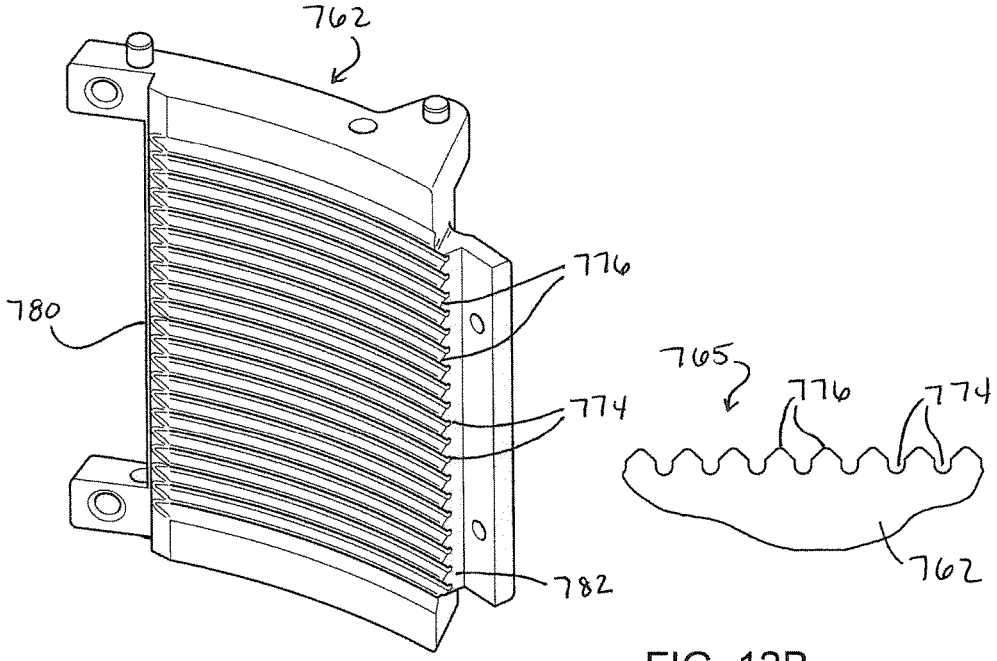

FIGS. 12A and 12B depict two different shoes 662 and 762 that have aligned channels 674 and 774 (as defined herein) that extend between the respective leading edges 680 or 780 and trailing edge 682 or 782 of the shoes 662 and 762, but are fabricated to have surfaces 676 and 776 between the channels 674 and 774 that differ from the surfaces 76 represented in FIGS. 6-10. In particular, though the channels 674 and 774 have U-shaped cross-sectional shapes, the surfaces 676 and 776 therebetween are not collinear when viewed in cross-section along a section parallel to the axis of the cutting head 50, as evident from the surface geometries (profiles) shown in FIGS. 12A and 12B. The surface geometries represented in FIGS. 12A and 12B can be created by machining shoes 662 and 762 whose interior surfaces 665 and 765 have a corrugated or V-shaped waveform. FIG. 12A represents the channels 674 as being machined in the valleys of a shoe 662 whose interior surface 665 has a corrugated or sinusoidal shape characterized by rounded peaks and valleys when viewed edgewise, such that the surfaces 676 between channels 674 are defined by rounded peaks. FIG. 12B represents the channels 774 as being machined in the valleys of a shoe 762 whose interior surface 765 is defined by sharp peaks and valleys, such that the surfaces 776 between channels 774 are defined by sharp peaks. Knives having these periodic waveforms (minus the channels 674 and 774) are known in the art for producing sliced products often referred to as V-slices and crinkle slices.

While the invention has been described in terms of specific embodiments, it is apparent that other forms could be adopted by one skilled in the art. For example, shoes and gate inserts suitable for use therewith could differ in appearance and construction from the embodiments shown in the drawings, the cutting heads and impellers and the functions of their components could be performed by components of different construction but capable of a similar (though not necessarily equivalent) function, and various materials and processes could be used to fabricate the shoes and gate inserts. Therefore, the scope of the invention is to be limited only by the following claims.

The invention claimed is:

1. An apparatus for slicing products, the apparatus comprising an annular-shaped cutting head comprising:

an axis defining an axial direction;

knife assemblies located at a circumference of the cutting head, each knife assembly comprising a flat knife and means for securing the knife to the cutting head, each of the knives extending radially inward and in a first circumferential direction of the cutting head to define a gate opening and produce product slices with parallel cuts and a uniform thickness; and arcuate interior surfaces each located in the first circumferential direction relative to a corresponding one of the knife assemblies such that each of the interior surfaces defines a trailing edge that leads one of the knife assemblies and defines therewith the gate opening with the knife that trails the interior surface, and such that each of the interior surfaces defines a leading edge that trails a different one of the knife assemblies, each of the interior surfaces having a plurality of continuous flow paths defined therein that extend across at least a majority of the interior surface from adjacent a leading edge thereof and continuing through the trailing edge thereof and are fluidically connected to one of the gate openings between the interior surface and the knife that trails the interior surface;

wherein each of the continuous flow paths of each of the interior surfaces comprises first and second channels recessed in, respectively, a shoe member that defines the leading edge of the interior surface and a gate member that defines the trailing edge of the interior surface, each of the second channels being individually aligned with a corresponding one of the first channels, and the first channels having smaller cross-sectional areas and/or different cross-sectional shapes than the second channels aligned with the first channels.

2. The apparatus of claim 1, wherein the continuous flow paths extend entirely across the interior surfaces starting at the the leading edges thereof and continuing through the trailing edges thereof.

3. The apparatus of claim 1, wherein the continuous flow paths of each of the interior surfaces are parallel to each other.

4. The apparatus of claim 1, wherein the cross-sectional shapes of the first channels are U-shaped.

5. The apparatus of claim 1, wherein the first channels are separated by surfaces therebetween that are collinear with each other in the axial direction of the cutting head.

6. The apparatus of claim 1, wherein the first channels are separated by surfaces therebetween that are defined by rounded peaks.

7. The apparatus of claim 1, wherein the first channels are separated by surfaces therebetween that are defined by sharp peaks.

8. The apparatus of claim 1, wherein the cross-sectional shapes of the second channels are U-shaped.

9. The apparatus of claim 1, wherein the gate members comprise ribs that define raised edges that separate the second channels.

10. The apparatus of claim 1, wherein the cross-sectional shapes of the first channels are different from the second channels aligned with the first channels.

11. The apparatus of claim 1, wherein the second channels are separated by surfaces therebetween that are collinear with each other in the axial direction of the cutting head.

12. The apparatus of claim 1, wherein the cross-sectional areas of the first channels are smaller than the second channels aligned with the first channels.

13. The apparatus of claim 1, the apparatus further comprising an impeller coaxially mounted within the cutting head for rotation about an axis of the cutting head in a direction opposite the first circumferential direction of the cutting head, the impeller comprising one or more paddles circumferentially spaced along a perimeter thereof for delivering products radially outward toward the cutting head.

14. A method of using the apparatus of claim 13, the method comprising:

rotating the impeller;

supplying a lubricating fluid to the impeller;

supplying products to the impeller that are delivered radially outward toward the cutting head; and slicing the products with the knives of the cutting head to produce product slices with parallel cuts and a uniform thickness.

15. The method of claim 14, wherein the lubricating fluid is water that is recycled through the cutting head.

16. The method of claim 15, wherein the products are food products and the water contains starch solids.

* * * * *